US007892115B2

(12) United States Patent
Thompson et al.

(10) Patent No.: US 7,892,115 B2
(45) Date of Patent: Feb. 22, 2011

(54) BALL DROP METHOD AND SYSTEM

(75) Inventors: Randy Paul Thompson, 5609 Montana, Odessa, TX (US) 79762; Christopher A. Jacobs, Midland, TX (US); Denis Carl Dennis, Odessa, TX (US)

(73) Assignee: Randy Paul Thompson, Odessa, TX (US)

( * ) Notice: Subject to any disclaimer, the term of this patent is extended or adjusted under 35 U.S.C. 154(b) by 0 days.

(21) Appl. No.: 11/967,361

(22) Filed: Dec. 31, 2007

(65) Prior Publication Data

US 2009/0170640 A1 Jul. 2, 2009

(51) Int. Cl.
*A63B 67/00* (2006.01)

(52) U.S. Cl. ..... 473/422

(58) Field of Classification Search ..... 473/422, 473/415, 416

See application file for complete search history.

(56) References Cited

U.S. PATENT DOCUMENTS

| | | | | |
|---|---|---|---|---|
| 2,939,705 | A | 6/1960 | McCall, Jr. | |
| 3,677,544 | A | 7/1972 | Meyers et al. | |
| 3,999,753 | A | 12/1976 | Desilets et al. | |
| 4,021,036 | A | 5/1977 | Nelson et al. | |
| 4,132,214 | A | 1/1979 | Schnurr et al. | |
| 4,548,407 | A | 10/1985 | Sato | |
| D293,808 | S | 1/1988 | Durham et al. | |
| 4,830,372 | A | 5/1989 | Outlaw et al. | |
| 5,042,802 | A | 8/1991 | Depianta | |
| 5,066,010 | A | 11/1991 | Pingston | |
| D355,445 | S | 2/1995 | Boyd | |
| D355,936 | S | 2/1995 | Boyd | |
| 5,558,324 | A | 9/1996 | Jourdan | |
| 5,957,788 | A * | 9/1999 | Eze | 473/422 |
| 6,099,417 | A | 8/2000 | Brown et al. | |
| 6,283,876 | B1 * | 9/2001 | Northcutt | 473/422 |
| 6,296,581 | B1 | 10/2001 | Sever | |
| 6,350,211 | B1 * | 2/2002 | Kolmar | 473/454 |
| 6,616,555 | B2 | 9/2003 | Bewley | |
| 6,974,396 | B2 | 12/2005 | Mauer et al. | |
| 7,063,325 | B1 | 6/2006 | Smith et al. | |
| 7,263,953 | B2 * | 9/2007 | Sundararajan | 119/719 |
| 2005/0009646 | A1 | 1/2005 | Johnston | |
| 2006/0003857 | A1 | 1/2006 | Mauer et al. | |
| 2006/0196488 | A1 | 9/2006 | Morshed et al. | |

* cited by examiner

*Primary Examiner*—Gene Kim
*Assistant Examiner*—Amir Klayman
(74) *Attorney, Agent, or Firm*—Locke Lord Bissell & Liddell LLP

(57) ABSTRACT

A method of practicing athletic skills is disclosed along with systems associated therewith. The method may include providing a ball drop system and an athlete in a first position. The ball drop system may drop a ball and may prompt the athlete to leave the first position and move their entire body at least one step length to a second position. The second position may be in contact with or proximate to the ball drop system or dropped ball.

9 Claims, 2 Drawing Sheets

BALL DROP METHOD AND SYSTEM

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The inventions disclosed and taught herein relate generally to a system and method for practicing athletic skill; and more specifically relate to a system and method for practicing skills such as athletic field agility and reaction time.

2. Description of the Related Art

A variety of teaching machines for sports, such as baseball and tennis have been proposed. In U.S. Pat. No. 4,021,036 a tennis teaching machine has a ball hopper slidably mounted on a vertical support. A hollow extension arm protrudes from the ball hopper and has a ball projection mechanism at the end. In U.S. Pat. No. 4,830,372 a series of balls are successively released from a ball magazine and deflected into a batter's hitting zone. The batting practice device comprises a ball magazine and associated ball release mechanism supported on a substantially vertical support post above an apparatus for deflecting a ball discharged from the ball magazine. In U.S. Pat. No. 5,042,802 a batting practice apparatus is provided wherein the same permits selective delivery and angular positioning and speed of a baseball directed at an associated batter. In U.S. Pat. No. 5,066,010 a ball dispensing machine is disclosed for practicing hitting that includes a carrier mounted on a stand having both a load end and a discharge end. The device relates to positioning a ball, of any variety, in a position desired by the individual for automatically or manually delivering succeeding balls to the desired position after each ball is struck by the individual. The prior art thus discloses devices that may have one exit for a ball wherein a delivered ball may have a predetermined path, such as toward a batter or tennis player's hitting zone.

The inventions disclosed and taught herein are directed to an improved method and system for practicing athletic skills.

BRIEF SUMMARY OF THE INVENTION

A method of practicing athletic skills is disclosed along with systems associated therewith. The method may include providing a ball drop system and an athlete in a first position. The ball drop system may drop a ball and may prompt the athlete to leave the first position and move their entire body at least one step length to a second position. The second position may be in contact with or proximate to the ball drop system or dropped ball.

The disclosure provides a method of practicing athletic skills, such as reaction time and field agility. The method may include providing a ball drop system having at least one ball exit and providing an athlete in a first position such as, for example, a "ready" position. The first position may be some distance, such as a distance greater than one step length of the athlete, from the ball drop system. The method may further include actuating the ball drop system such that a ball is dropped, which may for example prompt the athlete to leave the first position and move their entire body toward a second position. A second position may be proximate to the ball drop zone, or the approximate area on a landing surface the dropped ball may first contact if allowed to fall freely from a ball exit.

The disclosure provides a ball drop system for practicing athletic skills including, for example, a ball tube having a ball entrance port and at least one ball exit. The disclosure further provides an automatic ball feeder coupled to the ball exit, a timer coupled to the automatic ball feeder, and a proximity sensor coupled to the timer. The timer may, for example, be adapted to start when a ball leaves at least one of the ball exits and stop when the ball triggers the proximity sensor.

The disclosure provides a ball drop system, the system having a ball holder and at least one ball exit and defining a ball path therebetween, including having a support system and at least one ball tube, having a ball entrance port and a plurality of ball exits, coupled to the support system. An automatic ball feeder may be disposed in the ball path, which path may be defined by one or more components of the ball drop system. Further, the disclosure provides that the ball drop system may receive support in the vertical, horizontal, or from any direction and the support system may function, at least in part, to help define the height from which a ball may drop.

DETAILED DESCRIPTION

Figure 1:
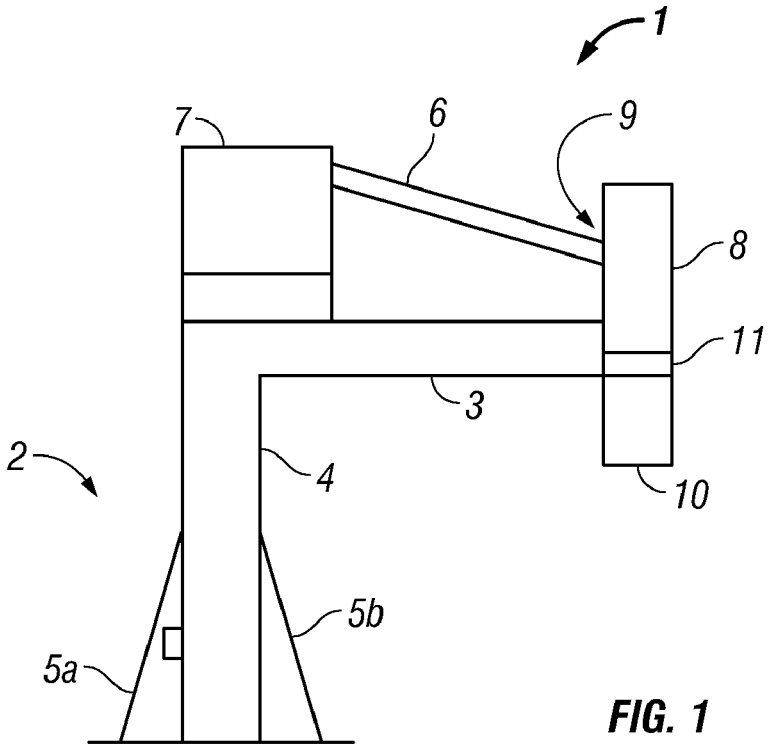
FIG. 1 is a schematic diagram of an exemplary embodiment of a ball drop system.

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill this art having benefit of this disclosure. It must be understood that the inventions disclosed and taught herein are susceptible to numerous and various modifications and alternative forms.

Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

The term "coupled," "coupling," "coupler," and like terms are used broadly herein and can include any method or device for securing, binding, bonding, fastening, attaching, joining, inserting therein, forming thereon or therein, communicating, or otherwise associating, for example, mechanically, magnetically, electrically, chemically, directly or indirectly with intermediate elements, one or more pieces of members together and can further include without limitation integrally forming one functional member with another in a unity fashion. The coupling can occur in any direction, including rotationally. Furthermore, the term "horizontal" as used herein includes any plane less than 45 degrees from the plane of horizon. Likewise, the term "vertical" includes any plane less than 45 degrees from an axis perpendicular to the plane of horizon. The term "contact," "contacting," and like terms are used broadly herein and include physical touching as well as a relationship proximate enough to cause an event, whether or not physical touching occurs. The term "ball" is also used broadly herein and may include balls such as tennis balls, racquet balls, baseballs, z-balls or the like, or may include custom manufactured balls in accordance with a particular application.

FIG. 1 is a schematic diagram of an exemplary embodiment of a ball drop system 1. In the embodiment illustrated in FIG. 1, a support system 2 is shown to include a horizontal member 3 coupled to a vertical member 4. The vertical member 4 is shown to be coupled to two support legs 5*a, b*, which may be foldable, adjustable or absent. In other embodiments, the vertical member 4 may, for example, be sunken in the ground or coupled to a base (not shown), which may have wheels, sit flat on the ground, both or neither.

The support system 2 may support one or more ball chutes 6, which may, for example, allow a ball to travel between one or more ball holders 7 and a ball tube 8, any of which may be fixed, adjustable, and/or removable. The ball chute 6 may be straight or curved, open or closed, and/or may provide a path, or portion thereof, for one or more balls at a time. The ball tube 8 may include a ball entrance port 9 and one or more ball exits 10. Furthermore, an automatic ball feeder 11 may be disposed in a ball path, such as between the ball holder 7 and a ball exit 10. The ball path, as referred to herein, may be any path a ball travels in the ball drop system or a portion thereof, and may be composed of any number of components in any order. In addition, a measuring device 12 may be included in the system 1, such as a measuring tape, string, or electronic distance finder, and may be used, for example, to measure a distance between the system 1 and a first position of an athlete using the system, such as a start or "ready" position.

Furthermore, it is contemplated that one or more horizontal members 3 may be coupled to one or more vertical members 4 at various radial positions around a vertical member 4. In such an embodiment, each horizontal member 3 may be, or be coupled to, one or more ball tubes 8 having one or more ball exits 10. A ball tube 8 may be straight or contoured, such as being curved or annular. For example, a system 1 may include a circinate ball tube 8 having one or more ball exits 10 disposed around a central vertical member 4 or support system 2.

Figure 2:
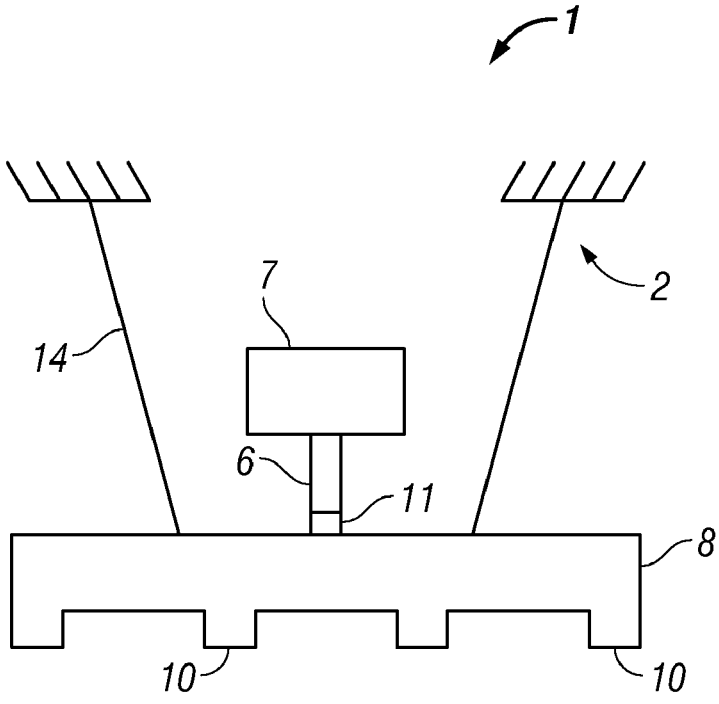
FIG. 2 is a schematic diagram of a second exemplary embodiment of a ball drop system.

FIG. 2 is a schematic diagram of a second exemplary embodiment of a ball drop system. The ball drop system 1 may be suspended a desired distance above the ground, such as by hanging, for example, from a ceiling or basketball goal. The system 1 may be suspended using one or more supports 14, which may include straps, chains, wires, or similar components. Once in place, a user may prompt the system 1 to drop a ball, whereupon the ball may, as an example, travel a path from the ball holder 7 through a ball chute 6 and into ball tube 8. Then, for example, a ball may exit the ball tube, such as from a ball exit 10. An automatic ball feeder 11 may be disposed in the ball path and may function to control, for example, one or more attributes of the system, such as the rate at which balls leave a holder 7 or an exit 10. Furthermore, the exit 10 from which a ball may drop may be known, unknown, predetermined by the user, at random, or any combination thereof.

Figure 3:
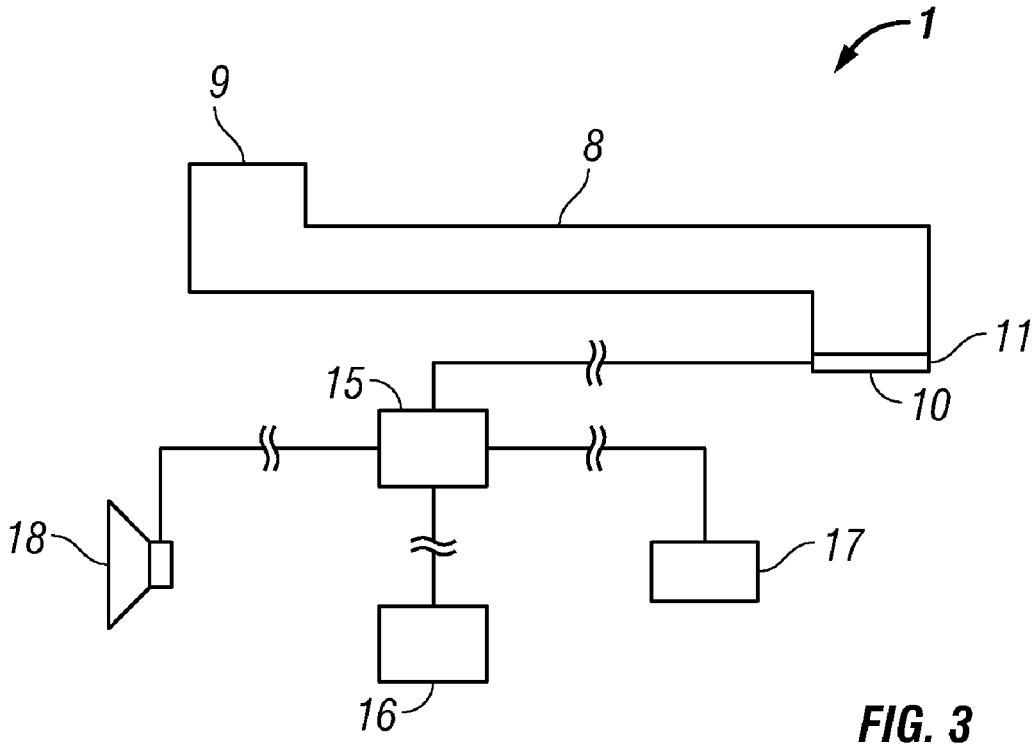
FIG. 3 is a schematic diagram of a third exemplary embodiment of a ball drop system.

FIG. 3 is a schematic diagram of a third exemplary embodiment of a ball drop system. A ball tube 8 may have a ball entrance port 9 and one or more ball exits 10. An automatic ball feeder 11 may be disposed along the ball path and may be coupled, for example electronically, to a timer 15, such as an electronic timer. In such an embodiment, a ball may actuate the ball feeder 11, such as by traveling a path proximate to it, thereby causing a change of state of the timer, such as prompting the timer to start or stop keeping time. In other embodiments, a fixed sensor (not shown), for example a proximity sensor, may be disposed proximate to the ball path, such as being fixed near a ball exit 10, and electronically coupled to the timer 15. In such embodiments, the sensor may stop or start a timer upon actuation, such as when the ball contacts or passes proximate to the sensor.

One or more actuating pedals 16 may be coupled to the system 1, such as to the timer 15. The pedal 16 may, for example, allow an athlete to reset, start, or stop a timer 15, or may function to prompt one or more balls to drop, or any combination thereof. The system 1 may further include at least one mobile proximity sensor 17 capable of electronic communication with the timer 15, such as via a transmitter or similar device. The sensor 17 may be coupled, for example, to an athlete's body, such as by a wristband, necklace, or ring. Alternatively, the sensor 17 may be coupled to equipment controlled by an athlete such as, for example, a glove, shoe, lacrosse stick, racquet or bat. The sensor 17 may cause a change of state in one or more components of the system 1 upon being triggered, such as when a dropped ball contacts or comes proximate to the sensor 17.

As shown in FIG. 3, at least one embodiment of system 1 in accordance with the present invention may include an audio system 18, which may include a speaker, pizio electric crystal or other sound generating device. The audio system 18 may, for example, be electronically coupled to the timer 15 such as to emit sounds, such as a buzzer noise, applause, recorded message, or to announce the time recorded by the timer 15 upon the occurrence of an event. Such an event, for example, may include the stopping or starting of the timer, a ball contacting one or more sensors or other desired event. Similarly, one or more embodiments may include a video system (shown in FIG. 4), such as a fixed or handheld video camera, which may, for example, record and/or store an athlete's performance, the day and time of such a performance, or other relevant information. An exemplary embodiment may have one or more cameras, which may, for example, begin recording an athlete's activity at a desired time, such as automatically between actuation and a ball being dropped, manually at an appropriate time, or otherwise.

The pedal 16, sensor 17 and/or other components may be in direct electronic communication with the timer 15. Alternatively, one or more of these devices may communicate or otherwise function via an electronic junction, such as a circuit board, personal computer, or digital controller. Each device may do so singularly or in combination, wirelessly or otherwise. Furthermore, the electronic junction may be able to record and/or store data, such as times, weather conditions, information about an athlete, or other information. Such data may be recorded automatically, via user input or otherwise and/or may be downloadable, such as to a pin drive, for later use, printing, analysis or the like.

One exemplary ball drop system may allow a user, such as a coach or athlete, to control from which of one or more exits a ball drops and when a ball drops, such as at random or within a desired range, for example seven to fifteen seconds. Such control may be provided through any means, such as remotely from a distance or directly via a switch located on the machine. Furthermore, a system may include arms long enough to safely drop a ball away from the support members, for example a distance of three or four feet from an obstruction, such as a central vertical support post. The ball drop system may be foldable and may include a strap or bag, such as for transport or protection from the environment when not in use. One or more embodiments may further be electronically powered, such as via a wall outlet or battery. For example, a system may have a plurality of batteries, which may be rechargeable, such as to allow for continuous use. A ball holder may, for example, hold any number of balls and may be adapted, for example, to be removable, used to collect dropped balls, and/or to take place of an empty ball holder at a later time, such as to reload the ball drop system.

Further aspects of the present disclosure may include a method of practicing athletic skills, such as speed, coordination, and field agility. The method may include providing a ball drop system, such as one of the embodiments disclosed herein, and providing an athlete at a first position some desired distance from a ball drop zone. The desired distance may vary depending on any number of factors, such as the skill level of an athlete, their athletic abilities, the length of their stride, or the desired exercise. The desired distance may, for example, be equal to or greater than one step length of a particular athlete such that an athlete must move his or her entire body at least one step to reach a drop zone.

The method may further include actuating a ball drop system, such as by using a remote control, wireless or otherwise, or for example, a timer or actuating pedal. When a ball drop system is actuated, for instance, a ball may drop from a ball exit within some time, known or unknown, thereby prompting an athlete to leave a first position and to move their entire body toward the ball drop system as quickly as possible. For example, an athlete may run toward the dropped ball or the ball drop zone. An athlete may have one or more objectives, such as catching or contacting the dropped ball, or reaching a second position proximate to the dropped ball. Such an objective may be accomplished through a part of the athlete's body or, as another example, using a piece of athletic equipment controlled by the athlete, such as a glove.

Where a ball drop system is of an embodiment including a mobile proximity sensor 17, Applicants' method may further include causing a change of state of the ball drop system between when a ball drops and when the ball is sufficiently proximate to the proximity sensor to trigger the proximity sensor. A change of state of the ball drop system may, for example, include automatically determining a time, such as by triggering a timer to start and/or stop. A change of state may include causing some event, such as resetting a timer or prompting electronic devices to function or communicate such as by prompting an audio system to produce sound. The changes may occur singularly, simultaneously, or in any desired order and may be prompted wirelessly, remotely, or otherwise.

Figure 4:
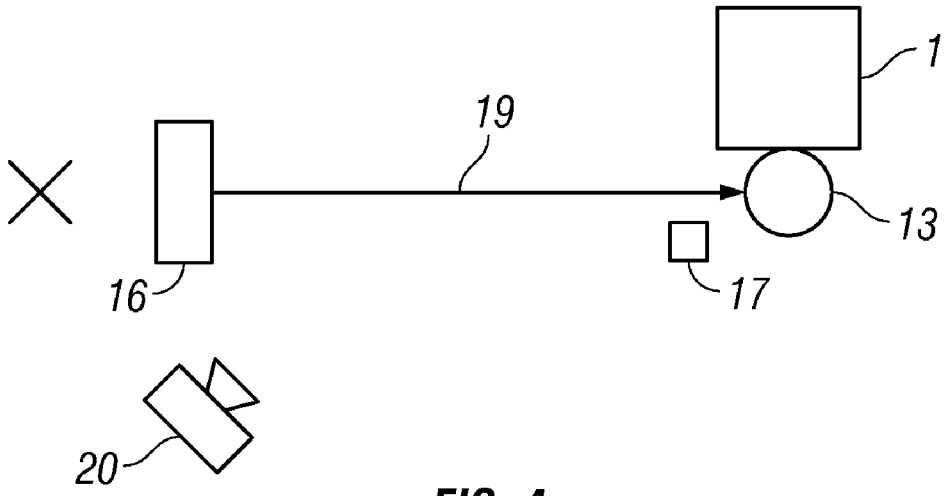
FIG. 4 is a schematic diagram to illustrate a method in accordance with the present disclosure.

FIG. 4 is a schematic diagram to illustrate a method in accordance with the present disclosure. An actuating pedal 16 may be provided at some desired distance from a ball drop zone 13 of the ball drop system 1, such as an area on the ground or a bounce pad, for example a contact surface adapted to deflect the ball in a desired or random direction. An athlete may assume a first position (indicated by "x" in FIG. 4), such as a ready position, and may, when ready, actuate the actuating pedal 16, such as by pressing a button or depressing a pedal. Upon actuation, a timer 15 may be reset and/or the ball drop system 1 may be prompted to drop a ball from any desired height, such as within the range of six to seven and one half feet from the ground, toward the ball drop zone 13 within some known or unknown time. Upon a ball being dropped, the timer 15 may start keeping time and the athlete may leave the first position and run down an athlete path 19, which may for example be straight, curved, or have hurdles, toward the dropped ball. Once the athlete contacts the dropped ball, a mobile proximity sensor 17, which may be coupled to the athlete or a piece of athletic equipment, may trigger one or more changes of state of the system 1, such as stopping the timer, emitting a buzzer sound, or prompting any other desired system reaction, singularly or in combination. A video system 20 can record and/or store the athlete's performance, the day and time of such a performance, or other relevant information. Furthermore, one or more athletes may be lined up behind the first position ("x") such that, for example, the next athlete in line may actuate the pedal 16, thereby prompting the system 1 to reach a desired state, such as being "reset," or such that the above method of practice may be repeated by a series of athletes.

Other and further embodiments utilizing one or more aspects of the inventions described above can be devised without departing from the spirit of Applicants' invention. For example, a ball drop system may drop more than one ball simultaneously and/or a plurality of athletes may practice their skills concurrently. Further, Applicants' invention may have a variety of applications, for example training a pet, physical therapy, or rehabilitation of disabled persons or even sports injuries. The various methods and embodiments of Applicants' ball drop system and method can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. A ball drop system for practicing athletic skill, comprising:

a ball tube having a ball entrance port and at least one ball exit;

an automatic ball feeder coupled to the ball exit;

a timer coupled to the automatic ball feeder;

a proximity sensor electronically coupled to the timer, the proximity sensor adapted to sense when the ball is proximate to the sensor and synchronized to the operation of the timer wherein the timer is adapted to start when the ball leaves at least one of the ball exits and stop when the ball triggers the proximity sensor.

2. The system of claim 1, wherein the proximity sensor is adapted to be coupled to a body of an athlete of the athlete and disposed a distance away from the ball exit, the distance being greater than one step length of the athlete and is adapted to stop the timer when the proximity sensor is sufficiently proximate to the ball to trigger the proximity sensor.

3. The system of claim 1, further comprising a plurality of ball exits and wherein a ball is allowed to drop from any one exit at random upon actuation of the system.

4. The system of claim 1, wherein the proximity sensor is adapted to be coupled to a body of an athlete.

5. The system of claim 1, wherein the proximity sensor is coupled to equipment controlled by the athlete.

6. The system of claim 1, further comprising a video system adapted to record at least some actions of the athlete while the athlete leaves the first position and moves their entire body toward the dropped ball in an effort to contact the ball.

7. The system of claim 1, wherein the support system comprises:

a vertical member; and a horizontal member coupled to the vertical member, the ball tube being coupled to the horizontal member.

8. The system of claim 1, further comprising an actuating pedal coupled to the automatic ball feeder.

9. The system of claim 1, further comprising an electronic speaker system coupled to the automatic ball feeder.

* * * * *